US011060336B2

(12) United States Patent
Mcgregor

(10) Patent No.: US 11,060,336 B2
(45) Date of Patent: Jul. 13, 2021

(54) WINDOW STAY

(71) Applicant: ASSA ABLOY NEW ZEALAND LIMITED, North Shore City (NZ)

(72) Inventor: Duncan Duff Mcgregor, Auckland (NZ)

(73) Assignee: ASSA ABLOY NEW ZEALAND LIMITED, North Shore City (NZ)

( * ) Notice: Subject to any disclaimer, the term of this patent is extended or adjusted under 35 U.S.C. 154(b) by 29 days.

(21) Appl. No.: 16/423,833

(22) Filed: May 28, 2019

(65) Prior Publication Data

US 2019/0368253 A1 Dec. 5, 2019

(30) Foreign Application Priority Data

May 30, 2018 (AU) ..... 2018203798

(51) Int. Cl.
*E05D 15/00* (2006.01)
*E05D 15/46* (2006.01)
(Continued)

(52) U.S. Cl.
CPC ..... *E05D 15/466* (2013.01); *E05C 17/045* (2013.01); *E05C 17/32* (2013.01); *E05D 2700/12* (2013.01); *E05Y 2900/148* (2013.01)

(58) Field of Classification Search
CPC ..... Y10T 16/545; Y10T 16/5453; Y10T 16/5457; Y10T 16/547; Y10T 16/6298;
(Continued)

(56) References Cited

U.S. PATENT DOCUMENTS 4,553,286 A * 11/1985 Schwarz, II ..... E05D 5/04 16/222
4,825,509 A * 5/1989 Mitchell ..... E05D 5/06 16/254

(Continued)

FOREIGN PATENT DOCUMENTS

EP 1703056 A2 * 9/2006 ..... E05D 5/0238
GB 2236802 4/1991

(Continued)

*Primary Examiner* — Chuck Y Mah
(74) *Attorney, Agent, or Firm* — Sheridan Ross P.C.

(57) ABSTRACT

A window stay, comprising: a frame plate; at least one arm coupled to the frame plate by a frame plate pivot; and a bearing plate engaged with the frame plate, the bearing plate and the frame plate together configured to be mounted to a window frame; wherein the bearing plate comprises a reinforcing insert for spreading a load applied through at least part of the at least one arm to the bearing plate; wherein the reinforcing insert is made of a material with more strength and/or rigidity than the material of the bearing plate. A window stay comprising: a frame plate; at least one arm coupled to the frame plate by a frame plate pivot; and a bearing plate engaged with the frame plate, the bearing plate and the frame plate together configured to be mounted to a window frame having a frame channel; wherein the bearing plate comprises a support member for supporting the bearing plate above the frame channel; wherein the support member is a projection that extends from beneath the bearing plate.

19 Claims, 15 Drawing Sheets

(51) Int. Cl.
*E05C 17/04* (2006.01)
*E05C 17/32* (2006.01)

(58) Field of Classification Search
CPC ..... Y10T 16/551; E05Y 2900/148; E05Y 2800/696; E05D 15/30; E05D 15/406; E05D 15/408; E05D 15/42; E05D 15/44; E05D 15/16; E05D 15/165; E05D 3/18; E05D 13/08; E05D 13/10; E05F 11/00; E05F 11/34
See application file for complete search history.

(56) References Cited

U.S. PATENT DOCUMENTS 4,833,754 A * 5/1989 Yang ..... E05D 15/30 16/337
5,083,344 A * 1/1992 Pettit ..... E05D 15/44 16/254
5,210,908 A * 5/1993 Bucher ..... E05C 17/32 16/342
5,509,177 A 4/1996 Hindin et al.
6,138,325 A 10/2000 Figliola et al.
6,442,898 B1 * 9/2002 Wu ..... E05D 15/44 49/246
6,804,859 B2 * 10/2004 Lu ..... G06F 1/1616 16/337
7,690,154 B2 * 4/2010 Muir ..... E05D 15/44 49/345
7,900,322 B2 * 3/2011 Doring ..... E05D 15/30 16/362
8,230,644 B2 * 7/2012 Lambertini ..... E05D 15/44 49/250
2008/0016778 A1 * 1/2008 Muir ..... E05D 15/30 49/345
2011/0131763 A1 * 6/2011 La See ..... E05D 15/30 16/364

FOREIGN PATENT DOCUMENTS

GB 2255800 11/1992
GB 2299372 A * 10/1996 ..... E05D 15/30
JP 08177303 A * 7/1996
JP 3180477 U * 12/2012 ..... E05D 5/0238

* cited by examiner

WINDOW STAY

CROSS-REFERENCE TO RELATED APPLICATION

This application claims the benefit of Australian Patent Application No. 2018203798 filed 30 May 2018, the entire disclosure of which is incorporated herein by reference.

FIELD

This invention relates to a window stay.

BACKGROUND

There is a trend towards larger windows, which means that windows have been getting bigger and heavier. With heavier windows, the window frame, which may be connected to the window sash by a suitable hinge (such as a window stay), must bear the load of the window sash and/or the hinge must bear the load of the window sash. This load may be due to the weight of window sash itself, wind loads applied to the window sash or loads arising when the sash is being moved from open and closed positions. If the load is too large, the window may fail. For example, the hinge may partially or completely fail or the frame may partially shear, sag or fail completely. The way in which the load affects the window will vary depending on whether the window is an awning window, casement window or some other configuration of window.

The window frame and window sash may be made of aluminium, uPVC, wood or other suitable material. While uPVC may be desirable in some applications for its beneficial properties (such as being a thermal insulator or being low maintenance), uPVC has less strength when compared to other materials, such as aluminium. Therefore, uPVC frames tend to fail under increased loads more frequently than aluminium, making them less well suited for larger windows. One option to increase frame strength is to have thicker frames, but this may not be desirable from a cost or aesthetic point of view.

Window stays come in various configurations. Typically, a window stay will include a frame plate and a sash plate, coupled together by an arrangement of arms. One example of a window stay is a four bar window stay. Four bar window stays include a frame plate (or plates) and a sash plate (or plates) which are coupled by a pair of arms. Typically, one arm is significantly shorter than the other arm. A pair of such window stays mounted between a window sash and window frame provide a means of controlling the opening and closing of the sash. Improvements may be made to window stays by lowering the cost, reducing the size, and/or increasing durability and weight carrying capacity.

SUMMARY

In example embodiment 1, there is provided a window stay, comprising: a frame plate; at least one arm coupled to the frame plate by a frame plate pivot; and a bearing plate engaged with the frame plate, the bearing plate and the frame plate together configured to be mounted to a window frame; wherein the bearing plate comprises a reinforcing insert for spreading a load applied through at least part of the at least one arm to the bearing plate; wherein the reinforcing insert is made of a material with more strength and/or rigidity than the material of the bearing plate.

In example embodiment 2, there is provided the window stay of example embodiment 1, wherein the bearing plate is made of plastic.

In example embodiment 3, there is provided the window stay of example embodiment 2, wherein the reinforcing insert is made of a material with more strength and/or rigidity than the plastic.

In example embodiment 4, there is provided the window stay of any preceding example embodiment, wherein the reinforcing insert is made of one of aluminium, steel or stainless steel.

In example embodiment 5, there is provided the window stay of any preceding example embodiment, wherein in use the bearing plate is disposed between the window frame and the frame plate, and the bearing plate has a first region which extends longitudinally beyond an end of the frame plate, the first region not engaged with the frame plate.

In example embodiment 6, there is provided the window stay of example embodiment 5, wherein the reinforcing insert is disposed between the window frame and at least part of the at least one arm.

In example embodiment 7, there is provided the window stay of example embodiment 6, wherein the reinforcing insert is disposed in the bearing plate so as to engage with at least part of the first region.

In example embodiment 8, there is provided the window stay of any preceding example embodiment, wherein the frame plate cooperates with the reinforcing insert to spread the load.

In example embodiment 9, there is provided the window stay of any preceding example embodiment, wherein the load is at least partially the load of a window sash.

In example embodiment 10, there is provided the window stay of any preceding example embodiment, wherein the bearing plate has an insert recess for receiving the reinforcing insert.

In example embodiment 11, there is provided the window stay of any preceding example embodiment, wherein the reinforcing insert is substantially or fully enclosed in the bearing plate.

In example embodiment 12, there is provided the window stay of any preceding example embodiment, wherein the bearing plate has a frame plate recess for receiving the frame plate.

In example embodiment 13, there is provided the window stay of any preceding example embodiment, wherein at least one of the reinforcing insert or the frame plate comprises a strengthening form substantially aligned with a longitudinal axis of the frame plate.

In example embodiment 14, there is provided the window stay of example embodiment 13, wherein the strengthening form is a rib.

In example embodiment 15, there is provided the window stay of any preceding example embodiment, further comprising a sash plate, and wherein the at least one arm comprises: a short arm coupled by a pivot at each end to the frame plate and the sash plate; and a long arm coupled by a pivot at each end to the frame plate and the sash plate.

In example embodiment 16, there is provided the window stay of example embodiment 15, wherein the reinforcing insert is disposed between the window frame and at least part of the short arm.

In example embodiment 17, there is provided the window stay of example embodiment 16, wherein the reinforcing insert is disposed between the window frame and at least part of the pivot coupling the short arm to the frame plate.

In example embodiment 18, there is provided the window stay of example embodiment 17, wherein the geometry of the window stay is such that, in a closed position of the window stay, the pivot coupling the long arm to the sash plate is situated between the pivot coupling the frame plate to the short arm and the pivot coupling the sash plate to the short arm.

In example embodiment 19, there is provided the window stay of example embodiment 17 or 18, wherein the geometry of the window stay is such that, in a fully open position of the window stay, the sash plate is at substantially 90 degrees to the frame plate.

In example embodiment 20, there is provided the window stay of any preceding example embodiment, wherein the window stay is a casement window stay.

In example embodiment 21, there is provided a window assembly comprising a window frame, a window sash and at least one window stay of any preceding example embodiment.

In example embodiment 22, there is provided the window assembly of example embodiment 21, wherein the window frame is made of uPVC.

In example embodiment 23, there is provided the window assembly of example embodiment 22, wherein the reinforcing insert spreads the load applied to at least part of the window frame.

In example embodiment 24, there is provided a window stay comprising: a frame plate; at least one arm coupled to the frame plate by a frame plate pivot; and a bearing plate engaged with the frame plate, the bearing plate and the frame plate together configured to be mounted to a window frame having a frame channel; wherein the bearing plate comprises a support member for supporting the bearing plate above the frame channel; wherein the support member is a projection that extends from beneath the bearing plate.

In example embodiment 25, there is provided the window stay of example embodiment 25, wherein the bearing plate is made of plastic.

In example embodiment 26, there is provided the window stay of example embodiment 24 or 25, wherein the support member is made of one of aluminium, steel, stainless steel or plastic.

In example embodiment 27, there is provided the window stay of any one of example embodiments 24 to 26, wherein the support member is formed integrally with the bearing plate.

In example embodiment 28, there is provided the window stay of any one of example embodiments 24 to 27, wherein the support member is disposed between a bottom of the frame channel and at least part of the at least one arm.

In example embodiment 29, there is provided the window stay of any one of example embodiments 24 to 28, wherein the bearing plate has a frame plate recess for receiving the frame plate.

In example embodiment 30, there is provided the window stay of any one of example embodiments 24 to 29, wherein the bearing plate comprises a reinforcing insert for spreading a load applied through at least part of the at least one arm to the bearing plate.

In example embodiment 31, there is provided the window stay of example embodiment 30, wherein the load is at least partially the load of a window sash.

In example embodiment 32, there is provided the window stay of example embodiment 30 or 31, wherein the reinforcing insert is configured to spread the load applied to at least part of the window frame.

In example embodiment 33, there is provided the window stay of any one of example embodiments 24 to 32, further comprising a sash plate, and wherein the at least one arm comprises: a short arm coupled by a pivot at each end to the frame plate and the sash plate; and a long arm coupled by a pivot at each end to the frame plate and the sash plate.

In example embodiment 34, there is provided the window stay of any one of example embodiments 24 to 33, wherein the window stay is a casement window stay.

In example embodiment 35, there is provided the window stay of any one of example embodiments 24 to 34, wherein the support member is provided along the length of the bearing plate.

In example embodiment 36, there is provided the window stay of any one of example embodiments 24 to 35, wherein the support member Is configured to be located within the frame channel.

In example embodiment 37, there is provided the window stay of any one of example embodiments 24 to 36, wherein the support member is configured to transfer a load of the bearing plate to the bottom of the frame channel.

In example embodiment 38, there is provided the window stay of any one of example embodiments 24 to 37, wherein the support member comprises a recess.

In example embodiment 39, there is provided the window assembly comprising a window frame, a window sash and at least one window stay of any of example embodiments 24 to 38.

In example embodiment 40, there is provided the window assembly of example embodiment 39, wherein the window frame is made of uPVC.

It is acknowledged that the terms "comprise", "comprises" and "comprising" may, under varying jurisdictions, be attributed with either an exclusive or an inclusive meaning. For the purpose of this specification, and unless otherwise noted, these terms are intended to have an inclusive meaning—i.e., they will be taken to mean an inclusion of the listed components which the use directly references, and possibly also of other non-specified components or elements.

Reference to any document in this specification does not constitute an admission that it is prior art, validly combinable with other documents or that it forms part of the common general knowledge.

BRIEF DESCRIPTION OF THE DRAWINGS

The accompanying drawings which are incorporated in and constitute part of the specification, illustrate embodiments of the invention and, together with the general description of the invention given above, and the detailed description of embodiments given below, serve to explain the principles of the invention, in which.

DETAILED DESCRIPTION

Window Stay Structure and Components

Figure 1:
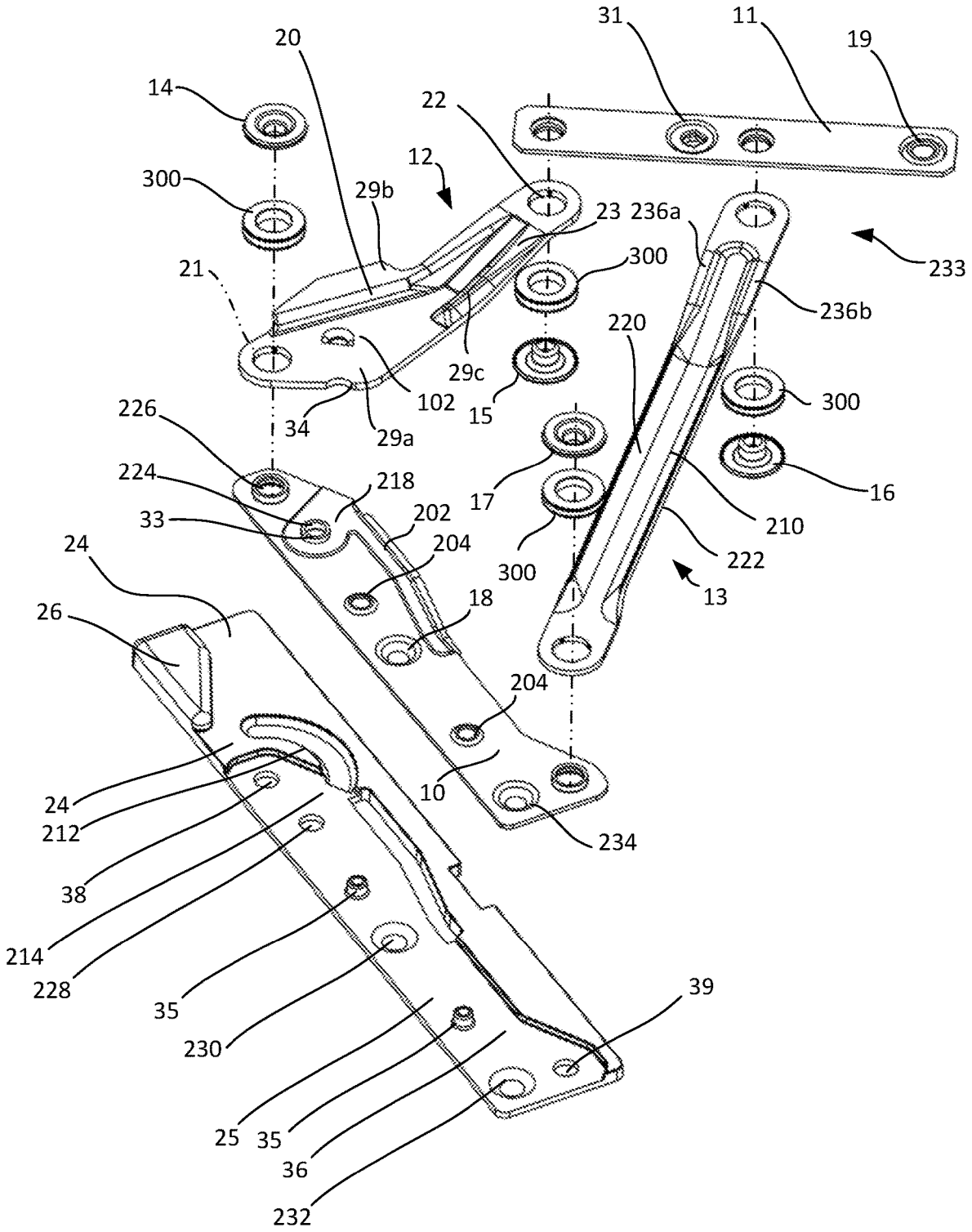
FIG. 1 is an exploded perspective view of a window stay according to one embodiment.
Figure 2A:
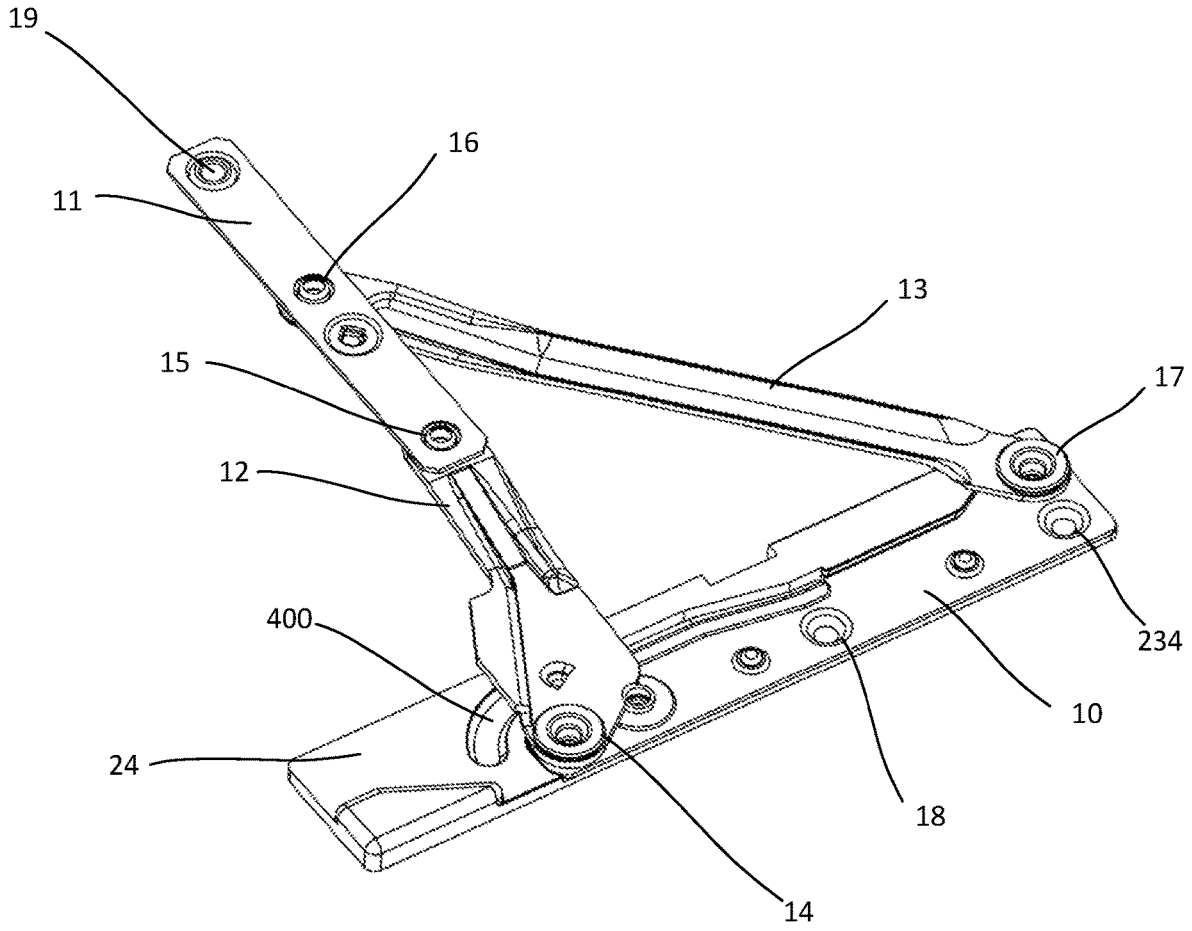
FIG. 2*a* is a perspective view of the top of the window stay of FIG. 1.
Figure 2B:
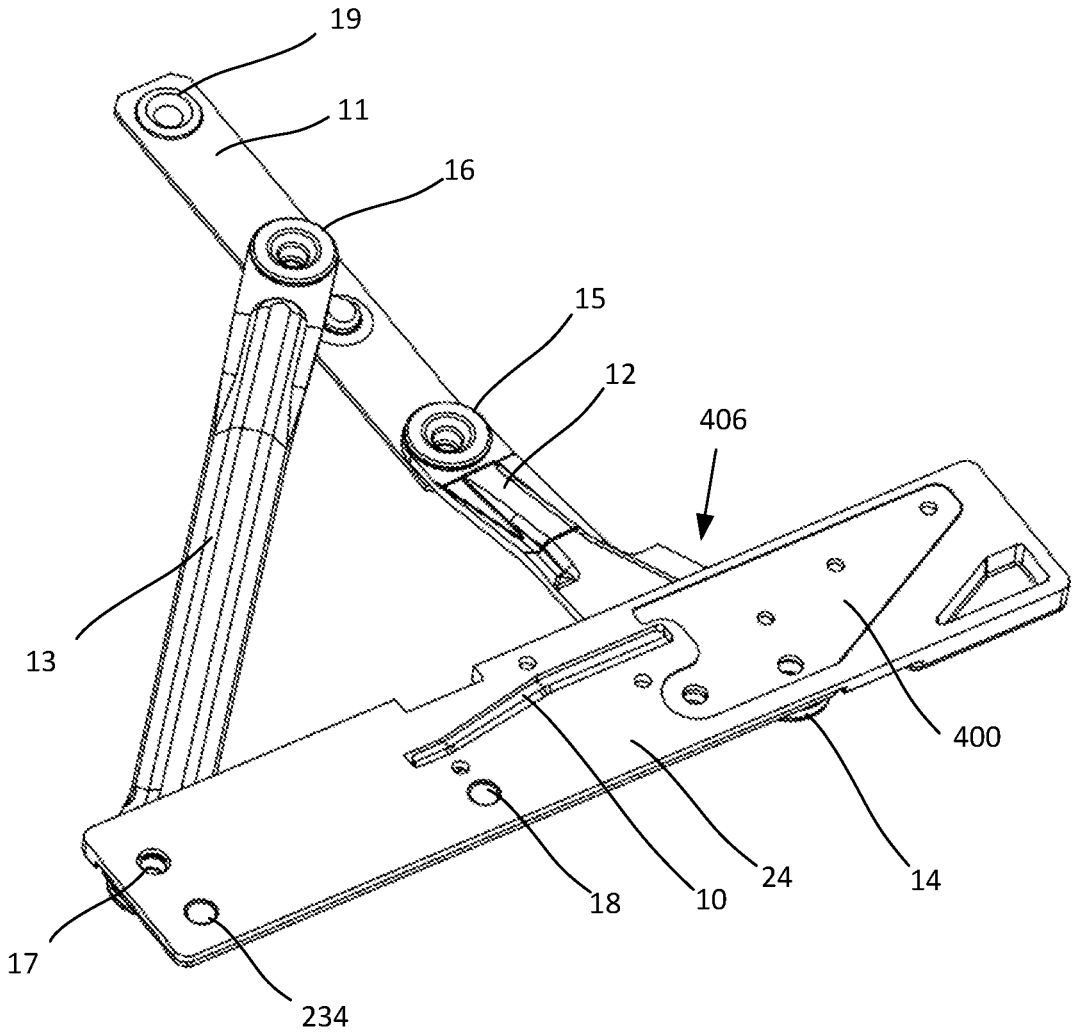
FIG. 2*b* is a perspective view of the bottom of the window stay of FIG. 1.
Figure 3A:
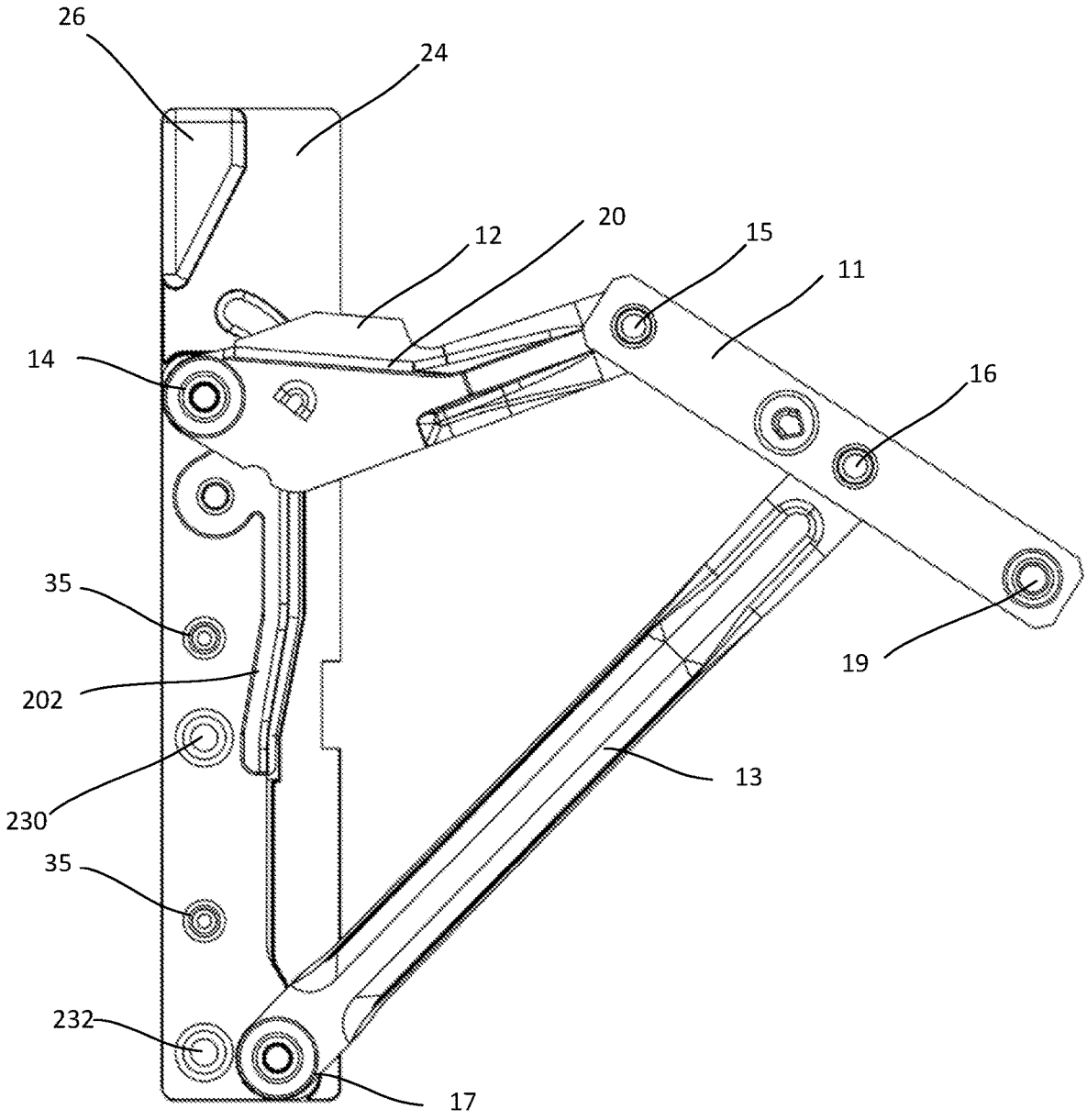
FIG. 3*a* is a top view of the window stay of FIG. 1 in a partially open position.
Figure 3B:
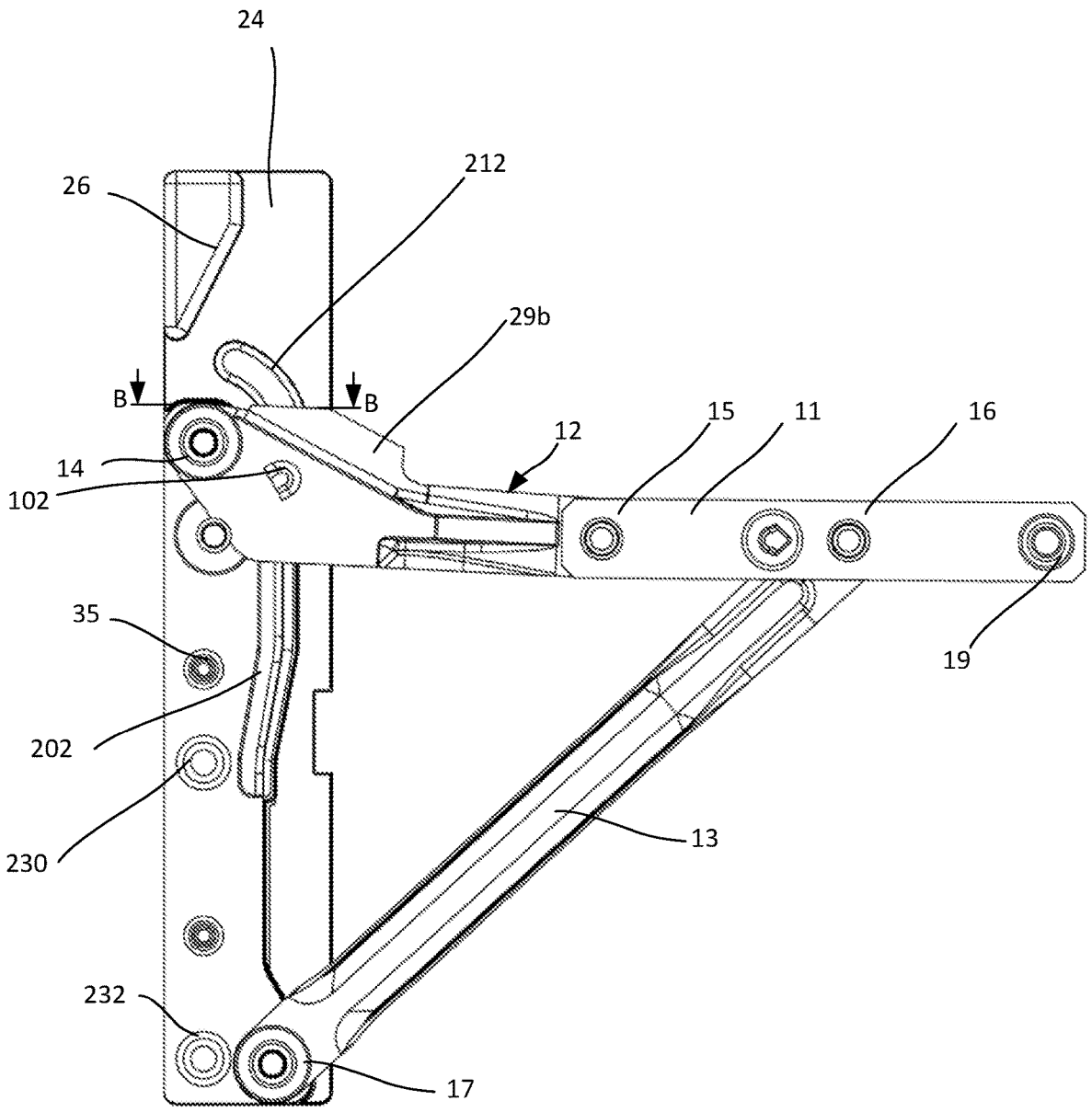
FIG. 3*b* is a top view of the window stay of FIG. 1 in a fully open position.
Figure 3C:
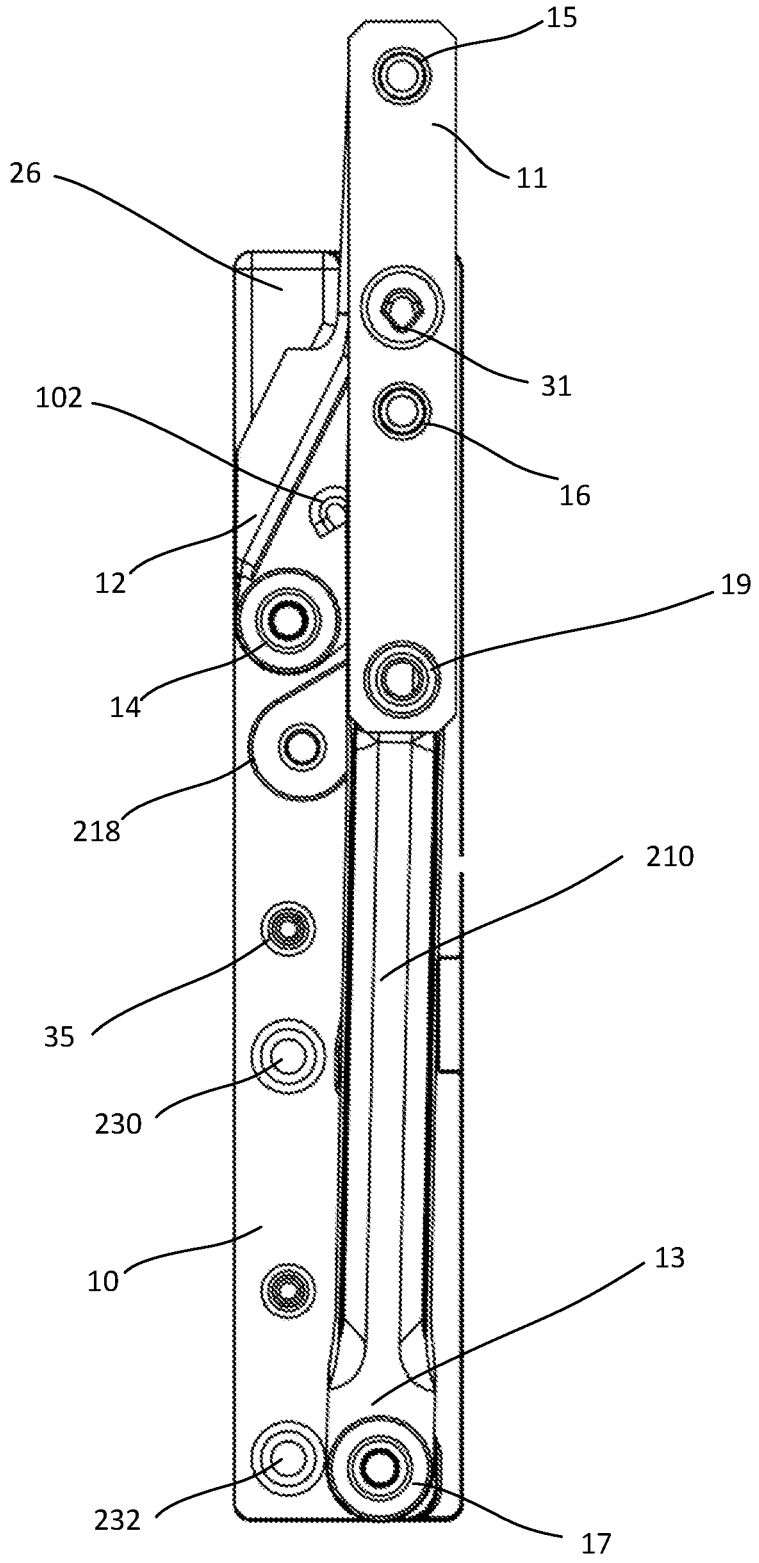
FIG. 3*c* is a top view of the window stay of FIG. 1 in a closed position.

While the present invention will be described in the context of a so-called four bar window stay, other configurations of window stay may be suitable. FIG. 1 is an exploded perspective view of a window stay according to an example embodiment. FIGS. 2*a* to 2*b* are perspective views of the window stay of FIG. 1. FIGS. 3*a* to 3*c* are top views of the window stay of FIGS. 1 to 2*b* in a partially open position, a fully open position and closed position respectively. In the fully open position, the sash plate 11 is at substantially 90 degrees to the frame plate 10. In other embodiments, the window stay 1 may open to a greater or lesser extent.

Referring to FIGS. 1 to 3*c*, the window stay 1 includes a frame plate 10, a sash plate 11, a short arm 12 and a long arm 13. The frame plate 10 is engaged with a bearing plate 24. The frame plate 10 and bearing plate 24 together mount to a window frame (not shown). The sash plate 11 mounts directly to a window sash (not shown). As shown in FIG. 2*b*, the bearing plate 24 may include a reinforcing insert 400. The components may include suitable strengthening ribs, recesses, forms and the like. The frame plate, the arms 12, 13 and the sash plate 11 may be made of aluminium, steel or stainless steel. The bearing plate may be made of plastic. The reinforcing insert may be made of aluminium, steel or stainless steel.

These components may be coupled together by pivots (which may be rivets of a friction type) and may include openings for attaching the window stay 1 to the window sash and/or window frame. In the described embodiments the pivots are riveted and associated with corresponding washers 300. The rivets may be made of aluminium, steel or stainless steel and the washers may be made of plastic.

The frame plate 10 and sash plate 11 may be provided with openings 18, 19 and 234 respectively through which fasteners (not shown) may be passed to attach the frame plate 10 and sash plate 11 to the window frame and window sash respectively. Fasteners (not shown) may also be passed through the pivot points to attach the window stay 1 to the window sash and window frame. In the drawings the pivot points are as follows:

- Pivot 14 is where the short arm 12 connects to the frame plate 10;
- Pivot 15 is where the short arm 12 connects to the sash plate 11;
- Pivot 16 is where the long arm 13 connects to the sash plate 11; and
- Pivot 17 is where the long arm 13 connects to the frame plate 10.

Frame Plate

A frame plate 10 includes an opening 226 for receiving a rivet 14 on which the short arm 12 pivots relative to the frame plate 10. The frame plate 10 also includes a raised section 218 including a hollow projection 33 surrounding an opening 224. The opening 224 is configured to receive a rivet or screw. As will be discussed in more detail below, the projection 33 acts as a stop for the short arm 12 when the window is opened.

The frame plate 10 may further include a strengthening form 202. Additional openings 18, 234 may be provided for engaging the frame plate to the bearing plate 24 and/or a window frame (not shown). The additional openings 18, 234 may align with corresponding openings 230 and 232 respectively of the bearing plate 24. The frame plate 10 may have a thickness of about 1.4 to 1.6 mm.

The frame plate 10 is configured to engage with the bearing plate 24. The frame plate may include openings 204 which receive corresponding studs 35 in the bearing plate 24. As will be described below, the bearing plate 24 may also include a recess 25 that corresponds to the frame plate 10. Further, the bearing plate 24 may include openings 39 and 38 that align with the rivets 14, 17 of the window stay for clearance.

The load of window sash is applied to the frame plate via the arms. In the four bar design, a majority of the load may be applied to the frame plate by the short arm 12, particularly at the point at which the short arm is attached to the frame plate i.e. rivet 14. However, some of the load may be applied by the arms themselves, particularly as the arms slide across the frame plate as the window stay moves from a closed position to a fully open position.

When the window stay is installed, fasteners (not shown) attach the frame plate together with the bearing plate to a window frame. The frame plate and bearing plate may include corresponding openings (for example, openings 18 and 230) which enable such fasteners to attach the frame plate and bearing plate to the window frame. When the window stay is installed, the bearing plate is between the window frame and the frame plate. Thus the load of the window sash, applied to the fame plate (as described above), is applied to the window frame via the bearing plate.

Figure 4A:
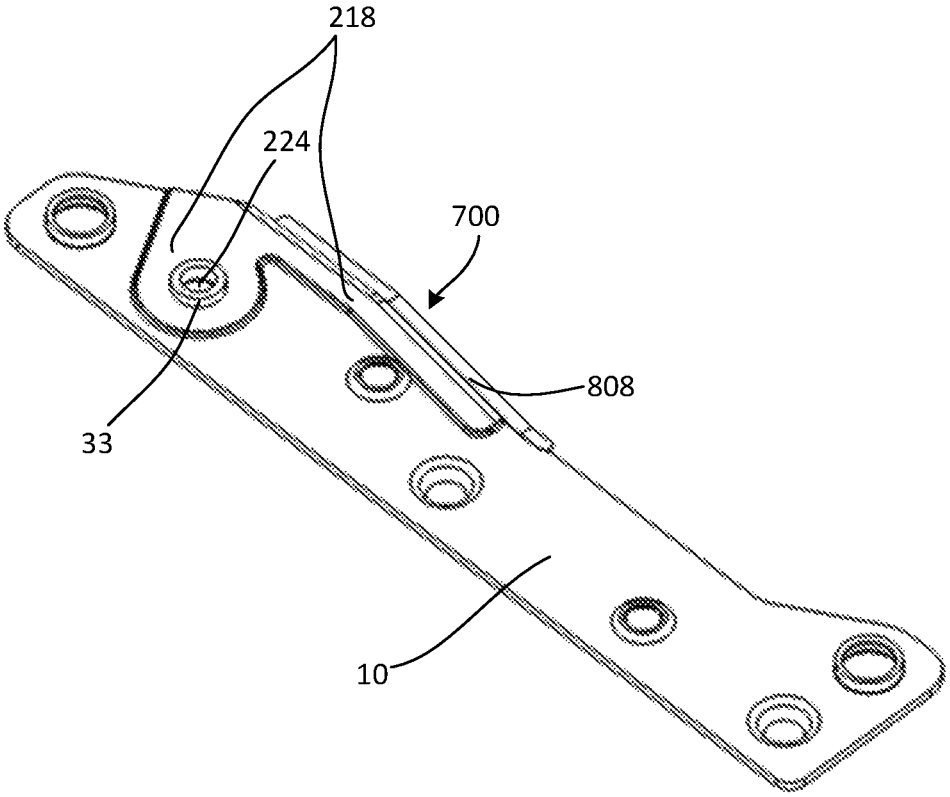
FIG. 4*a* is a perspective view of the top of a frame plate according to one embodiment.
Figure 4B:
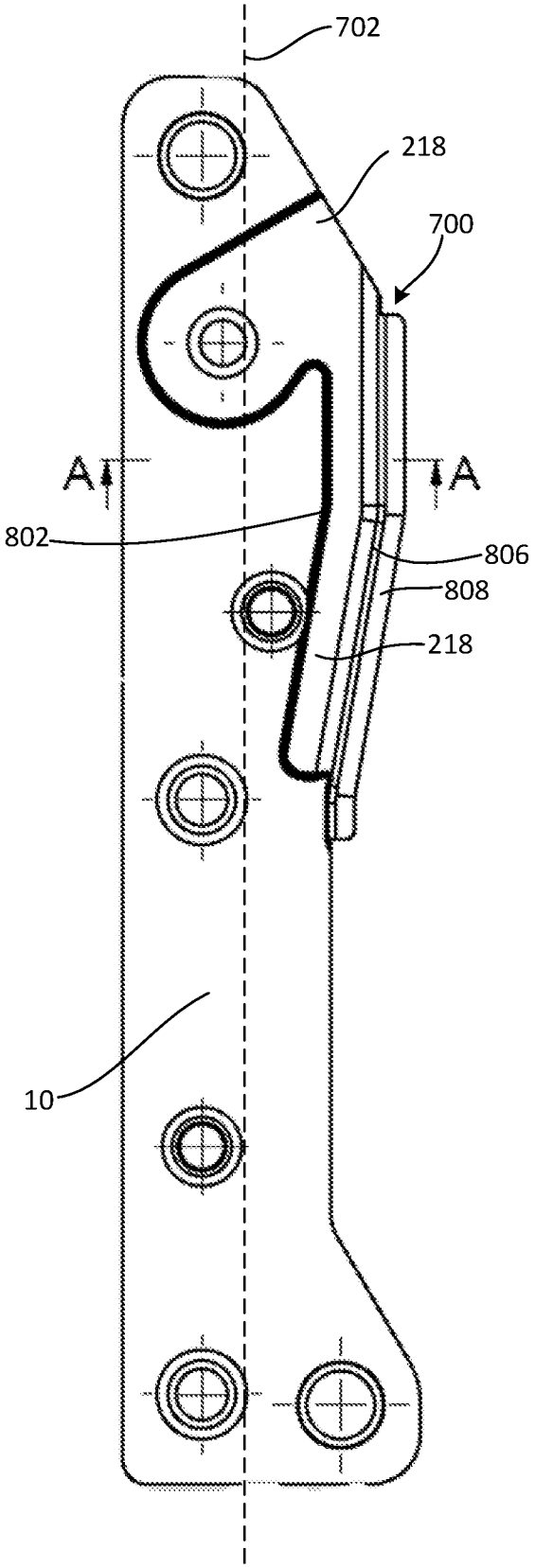
FIG. 4*b* is a top view of the frame plate of FIG. 4*a;*
Figure 4C:
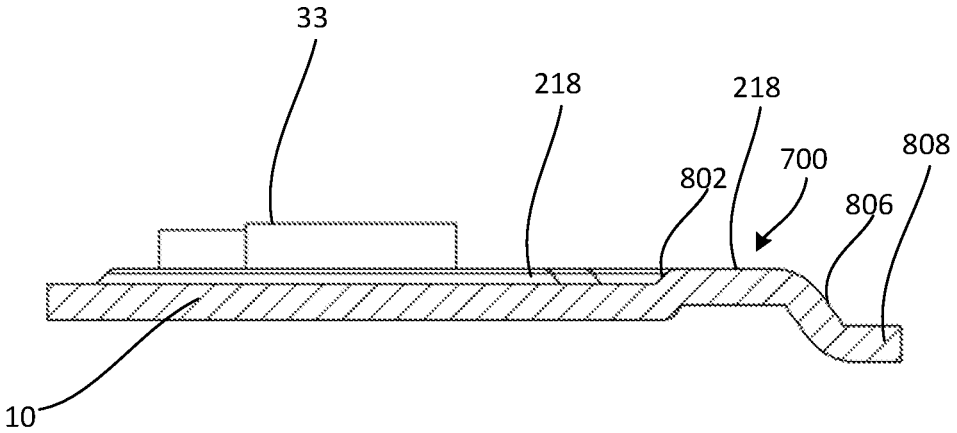
FIG. 4*c* is cross sectional view through A-A of the frame plate of FIG. 4*b;*

In the embodiment of the frame plate shown in FIGS. 4*a* to 4*c*, a strengthening form 700 is provided. As shown in FIG. 4*b*, the strengthening form 700 is substantially aligned with a longitudinal axis 702 of the frame. FIG. 4*c* shows a cross sectional view through A-A of FIG. 4*b*. This view shows how the frame plate 10 bends at two positions, a first sloping section 802 and a second sloping section 806 with a flat section 218 between, resulting in a strengthening form 700. The first sloping section 802 may be about 0.5 mm in height. The flat section 218 may be about 3 mm wide. The second sloping section 806 may be about 2 mm in height. While particular measurements have been given, it is to be understood that different sized window stays would use different measurements.

The strengthening form 700 may be located in a high-load region of the frame plate 10 (meaning it is a region of the frame plate 10 which is subject to a relatively large amount of stress in use). The strengthening form 700 strengthens the frame plate 10 by providing a rib that increases the rigidity of the frame plate 10. The strengthening form 700 strengthens the frame plate 10, by providing a greater height difference at the edge of the frame plate, which is a relatively high load region. The overall cross-sectional height of the frame plate 10 may be about 2.5-3.5 mm.

The angle of the first sloped section 802 and second sloped section 806 relative to the plane of the frame plate 10 may be between 45 degrees to 90 degrees. In the example embodiment shown in FIG. 4*c*, the angle of the second sloped section 806 relative to the plane of the frame plate is about 55 degrees.

An outermost edge 808 of the frame plate 10, which may be located by the strengthening form 700, may be lowered relative to the plane of the frame plate 10. The outermost edge may be about 2 mm wide. It will be appreciated from FIG. 4*c*, that the outermost edge may be low as a result of the second sloping section 806 having greater height than the first sloping section 802.

The outermost edge 808 may be configured to engage with a corresponding slot in the bearing plate 24, thereby allowing the frame plate 10 to engage with the bearing plate 24. The cooperation of the outermost edge 808 with the slot ensures the frame plate 10 is retained by the bearing plate 24 and that the two components are appropriately aligned. The slot can also be an aperture.

In embodiments with a strengthening form 700 as shown in FIGS. 4*a* to 4*c*, the material thickness of the frame plate 10 may be reduced to 1.2 mm. This thickness matches the thickness of other window hardware products, allowing raw material to be consolidated, and the use of existing/standard press forms to be used for the countersinks and other features.

Short Arm

Referring again to FIGS. 1 to 3*c*, the short arm 12 includes a central portion 29*a* and raised portions 29*b* and 29*c* on either side of the central portion 29*a*. The elevation between the central portion 29*a* and the raised portions 29*b* and 29*c* decreases towards an end of the short arm 12 (towards the end which connects to the sash plate 11 via pivot 15). The central portion 29*a* ramps upwards towards the level of the raised portions towards the end of the short arm 12 connecting to the sash plate. The raised portions 29*b* and 29*c* are substantially aligned on a plane to provide support for the short arm.

The short arm 12 includes a two-part fold line or step 20 (the step 20 corresponding to raised portion 29*b*). This fold line 20 lies at an angle to the line (not shown) extending between the centres of the openings 21 and 22 through which pivots 14 and 15 pass. Thus fold 20 can be described as passing diagonally across the width of the short arm 12 before veering to remain parallel to the opposing side of the arm. From the opening 22 toward the recess 34 runs a second fold 23 (corresponding to the raised portion 29*c*). This fold 23 forms a mirror to the second stage of fold line 20 which fades out as it extends along toward recess 34 (as it does not change direction in the same way as fold 20).

The short arm further includes a D stop 102, which acts with an additional stop to reduce force on the rivet 14. A recess 34 of the short arm is configured to engage with the projection 33 of the frame plate 10.

Sash Plate

An opening 19 may be provided through which fasteners (not shown) can be used for attaching the sash plate 11 to a window sash. Fasteners can also be inserted through the apertures in the pivots 15 and 16.

Double Stop

When the window stay 1 is opened, buckling of the window stay 1 is prevented by the provision of two separate stops in different locations.

A D stop 102 on the short arm 12 is configured to travel inside a curved channel 212 in the bearing plate 24 until it reaches the frame plate 10 at the end 214 of the curved channel 212. When the window stay and thus the window is fully opened (as shown in FIG. 3*b*), the D stop 102 abuts the raised section 218 of the frame plate 10 at the end 214 of the curved channel 212. The raised section 218 complements the D stop under a dynamic load. The raised section 218 raises the frame plate creating a stop surface on which the D stop 102 of the short arm 12 can act. This offset provides maximum stop contact by compensating for the thickness of the plastic washer (e.g. a plastic top-hat washer) between the short arm 12 and the frame plate 10. The height of this raised section 218 may equal the thickness of the washer. Other suitable analogous stop configurations may be used instead of the D stop 102. A sub-face D stop 102 and curved channel 212 prevents wearing of other components during operation of the stay.

A second stop is provided by the projection 33 from the frame plate 10. The recess 34 of the short arm 12 abuts the projection 33 when the window is opened (as shown in FIG. 3*b*). The recess 34 is of a complimentary shape to the projection 33.

Long Arm

Referring again to FIGS. 1 to 4, the long arm 13 may include streamlined strengthening features. The strengthening features may take the form of contours almost along the entire length of the long arm. The contouring of the long arm 13 diminishes towards the end 233 of the long arm 13 configured to attach to the sash plate 11, which allows the long arm 13 to slide under the sash plate 11 and short arm 12 when the window stay 1 is closed.

The long arm 13 includes a central portion 210 along a substantial length of the long arm; and raised portions 236*a* and 236*b* on either side of the central portion 210. The elevation between the central portion 210 and the raised portions 236*a*, 236*b* decreases towards the end 233 of the arm. The top of the raised portions 236*a*, 236*b* are substantially aligned on a plane to provide support for the sash plate 11.

The raised strengthening ribs 220, 222 on either side of a central strip 210 extend most of the length of the long arm 13. The ribs 220, 222 are optimized to provide rigidity to the long arm 13 without obstructing the other components of the window stay 1 during the operating range from closed to fully open.

The angle at which the strengthening ribs 220, 222 extend from the length of the long arm is configured to provide central portion 210 contact with the bearing plate as close as possible to the long arm/sash plate pivot 16, whilst allowing the long arm 13 to pass over the short arm 12 in the closed position. In one embodiment, the angle is substantially 45 degrees (between 40 degrees and 50 degrees). The closer the support is to the pivot 16, the higher the load it can carry without deflecting. Along the plane of the long arm 13 (the plane being parallel with the longitudinal axis of the long arm 13), as the central strip 210 rises, the ribs 220, 222 twist near the end 233, turning into flat sections 236*a*, 236*b* substantially parallel to the plane of the long arm 13. The flat sections 236*a*, 236*b* may be wide enough as not to indent the bearing plate 24 but not so wide as to affect the height of the raised strips resulting in decreased rigidity of the long arm.

The end 233 of the long arm 13 may be offset from the rest of the long arm to slide under the short arm 12 as the window stay 1 closes. The offset height is determined by the cavity width between the window sash and window frame.

The long arm is formed from a coil of parallel slit strip. The width of the formed long arm is determined by the angle that the ribs 220, 222 are bent to.

Bearing Plate

Referring to FIGS. 1 to 3*c*, there is shown a bearing plate 24. As previously described, the bearing plate 24 is engaged with the frame plate 10, such that when installed the bearing plate is disposed between the frame plate and window frame. The bearing plate 24 may transfer the load of the frame plate 10 to the window frame. The bearing plate may also bear at least some of the load of the window sash directly (i.e. not via the frame plate). This is particularly the case when the arms of the window stay slide across the bearing plate directly as the window stay moves to a closed position.

The bearing plate 24 may be made of a lower cost material such as a plastic. The material of the bearing plate may be self-lubricating. The bearing plate may be polished for aesthetics.

The bearing plate 24 is provided with means for correctly locating the frame plate 10. This means can take different forms but in the embodiment shown in FIGS. 1 to 3*c*, it is a recess 25. The recess 25 may have a depth substantially equal to the thickness of the frame plate 10. The shape of the recess 25 may be complementary to that of the frame plate 10 so as to locate the frame plate 10 within the recess in a precise manner.

Integrally formed in the floor 36 of the recess 25 are studs 35 which align with openings 204 in frame plate 10. The floor 36 may also include openings 38, 39 which align with and accommodate projecting parts of rivets 14 and 17 respectively.

Bearing plates of different thicknesses may be provided to allow for inexpensive adaptation of the window stay 1 for different cavity thicknesses. Additionally, bearing plates may vary in depth by the inclusion of an extension of the bearing plate behind the frame plate to allow for inexpensive adaptation of the window stay 1 for different cavity widths. Various additional features that can interact with the window frame may also be added to the bearing plate to support its position for example an extension underneath that sits inside a slot on the window frame underneath the window stay 1 position.

Figure 5A:
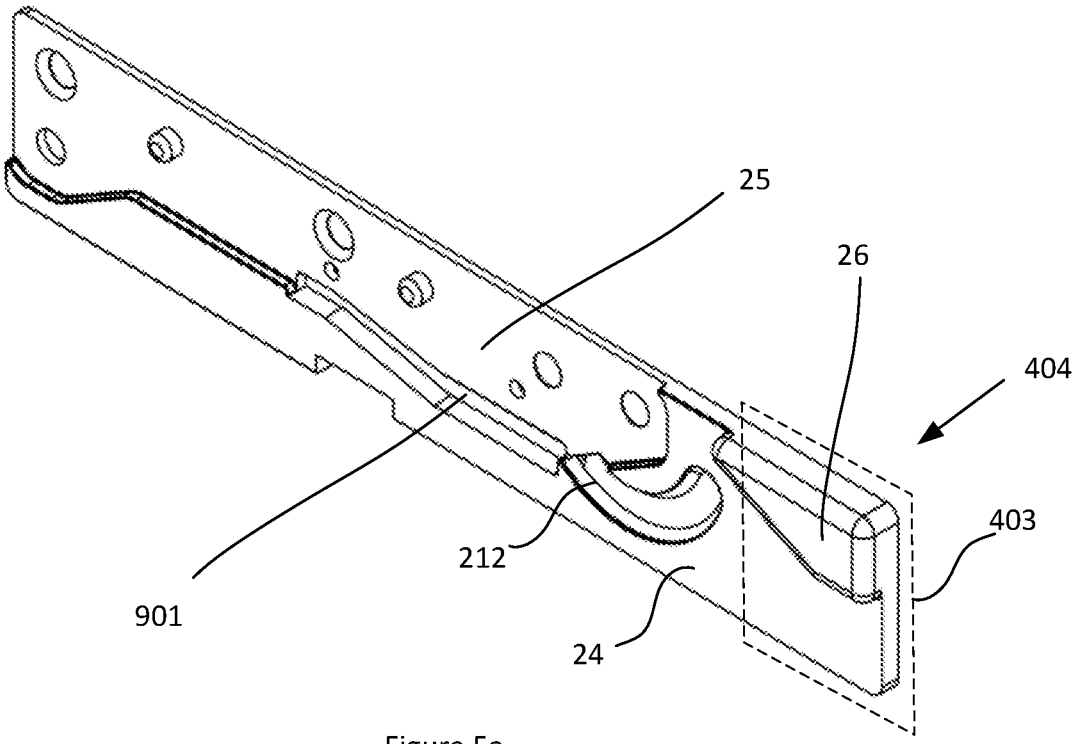
FIG. 5*a* is a perspective view of the top a bearing plate according to one embodiment.

The bearing plate 24 may have a region 404 which extends longitudinally beyond an end of the frame plate. This is shown in FIG. 5*a* by the region generally enclosed by dashed line 403. This region is not engaged with the frame plate, and as will be described in more detail below, may correspond to a region to which a reinforcing insert is located.

One end of the bearing plate 24 can be provided with a region of increased thickness 26 which provides a stop against which the short arm 12 engages (preferably at the step provided by fold 20) and partially overlaps when the window stay 1 is in the closed position.

In order to provide support for the underside of the long arm 13 and support of the short arm 12, the bearing plate may have as much surface area under the long arm 13 and short arm 12 as possible without impeding the closing of the window sash. The bearing plate 24 can engage with the window sash as the window sash closes such as to directly carry the weight of the window sash and position it upon closing of the window stay 1.

The bearing plate 24 thus not only provides convenience for correct location of the frame plate 10 to the window frame at installation but also provides other useful features connected with correct operation of the window stay 1 and positioning of the window sash.

Figure 5B:
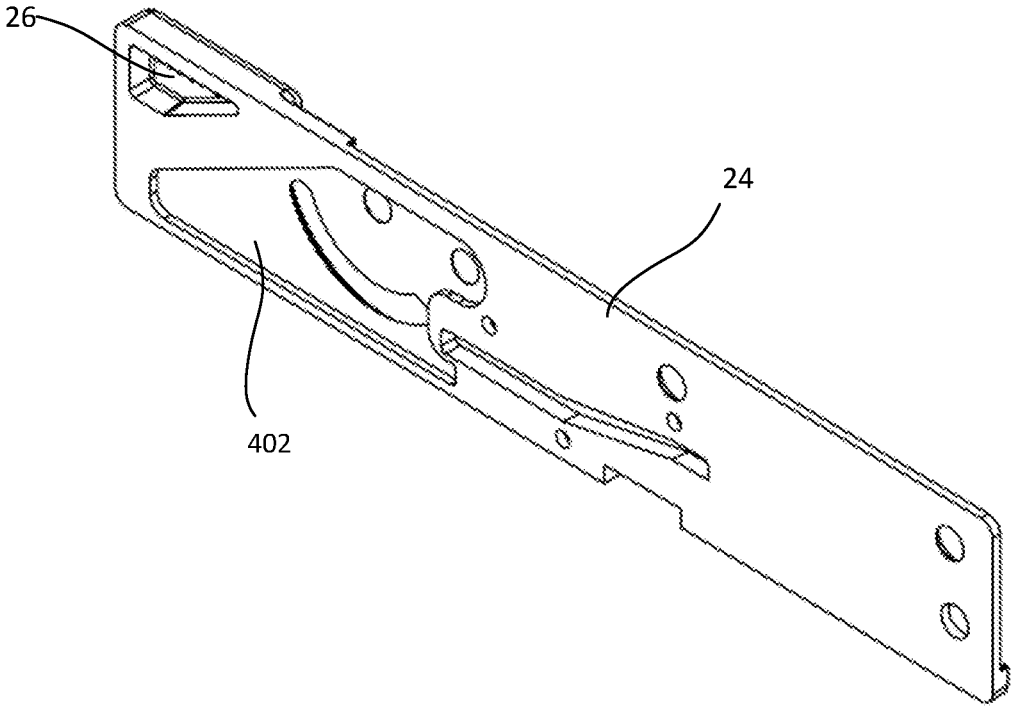
FIG. 5*b* is a perspective view of the bottom of the bearing plate of FIG. 5*a;*

The lowered edge 808 allows the frame plate 10 to insert into a slot 901 (which in other variations may be an aperture) in the plastic bearing plate 24. FIG. 5*a* shows a perspective view of a bearing plate 24 according to one embodiment, configured to retain the frame plate 10 of FIG. 4*a*. FIG. 5*b* shows a perspective view of the bottom of bearing plate 24 of FIG. 5*a*. The bottom of the bearing plate 24 may include a reinforcing plate recess 402.

Figure 6:
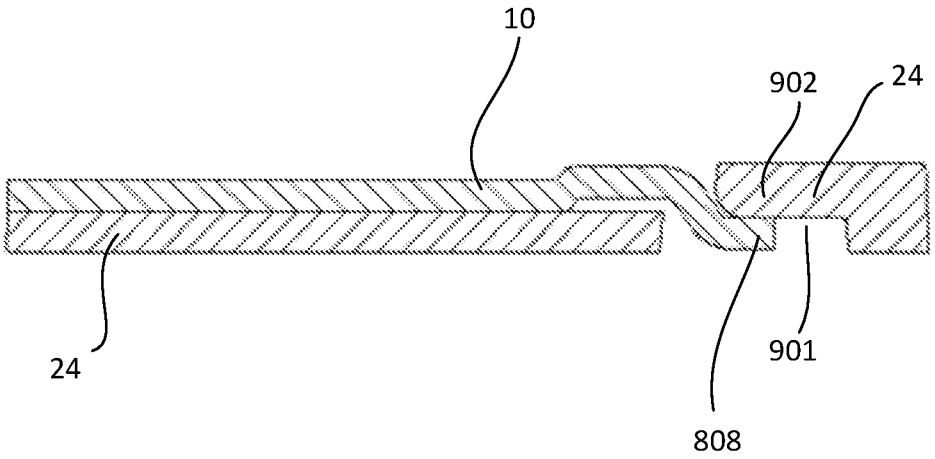
FIG. 6 is a cross sectional view through A-A of the frame plate of FIG. 4*b* engaged with a bearing plate.
Figure 7A:
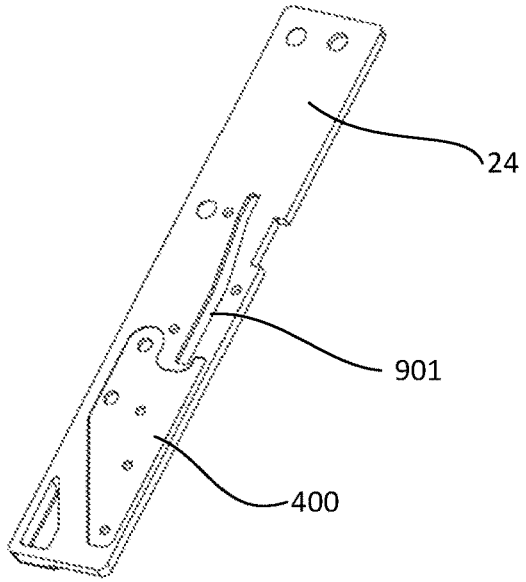
FIG. 7*a* is a perspective view of the bottom of a bearing plate including a reinforcing insert according to one embodiment.
Figure 7B:
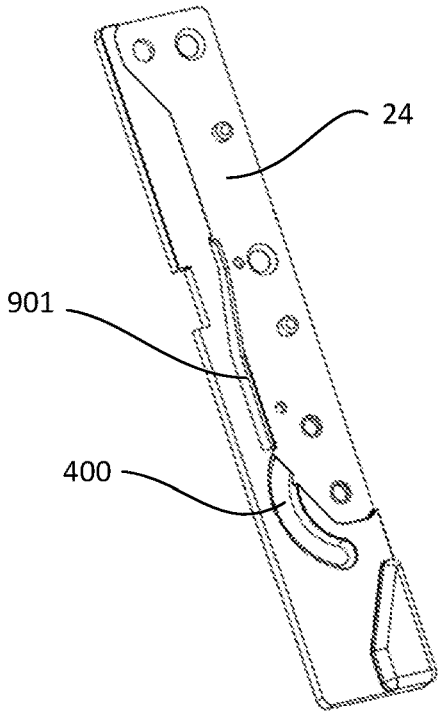
FIG. 7*b* is a perspective view of the top of the bearing plate of FIG. 7*a;*
Figure 7C:
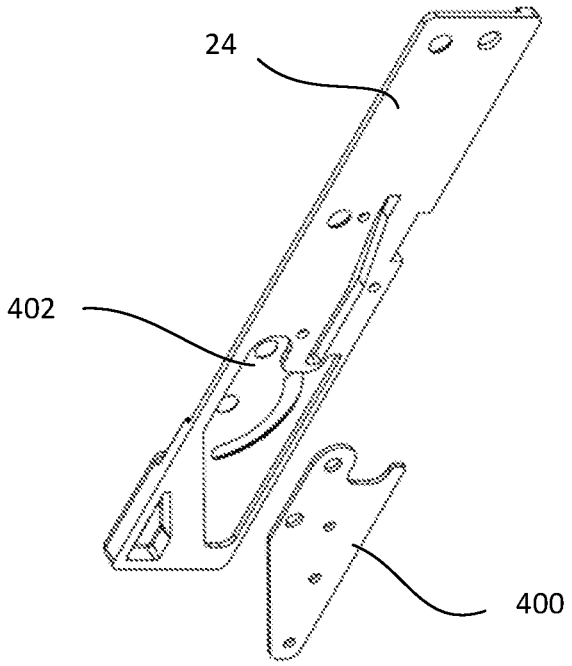
FIG. 7*c* is an exploded perspective view of the bearing plate of FIG. 7*a;*
Figure 7D:
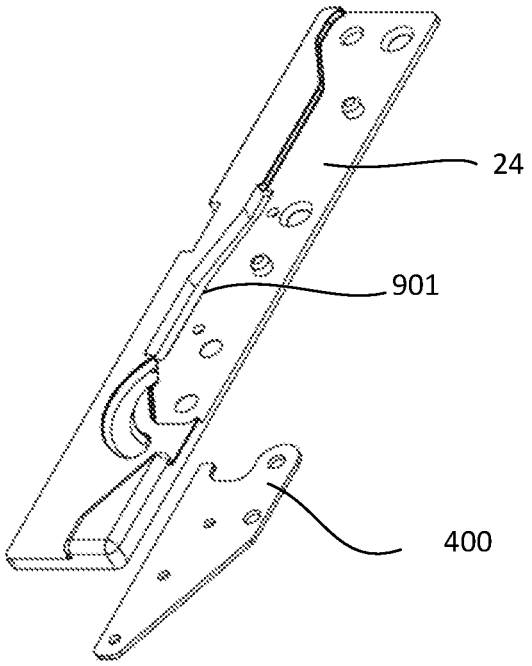
FIG. 7*d* is an exploded perspective view of the bearing plate of FIG. 7*b;*

FIG. 6 shows a cross sectional view of the frame plate 10 located in the bearing plate 24 of FIG. 5*b*. The outer edge 808 of the frame plate 10 slots into a slot 901 in the bearing plate under a ridge 902 of the bearing plate. In another embodiment, the frame plate rests inside an aperture in the bearing plate rather than slotted into the bearing plate.

Reinforcing Insert

Referring now to FIGS. 7*a* to 7*d*, the bearing plate 24 may include a reinforcing insert 400.

The bearing plate 24 is provided with means for correctly locating the reinforcing insert 400. This means can take different forms but in the embodiment shown in FIG. 7*c*, it is an insert recess 402. The insert recess 402 may have a depth substantially equal to the thickness of the reinforcing insert 400. The shape of the insert recess 402 may be complementary to that of the reinforcing insert 400 so as to locate the reinforcing insert 400 within the insert recess 402 in a precise manner.

While the reinforcing insert of FIGS. 7*a* to 7*d* is shown as still being engaged to the surface of the bearing plate, in some embodiments the reinforcing insert may be partially, substantially or fully enclosed by the bearing plate. For example, the reinforcing insert may be formed integrally within the bearing plate.

The reinforcing insert 400 is made of a material with more strength and/or rigidity than the material of the bearing plate. For example, in embodiments where the bearing plate 24 is made of plastic, the reinforcing insert 400 is made of one of aluminium, steel or stainless steel.

In use, the reinforcing insert 400 spreads loads applied to the bearing plate 24 through at least part of an arm of the window stay 1. For example, without the reinforcing insert 400, a load applied to the frame plate 10 via the short arm pivot (for example, the load of the window sash) is transferred from the frame plate 10 to the bearing plate 24. Due to the low rigidity of the bearing plate 24, the load is substantially transferred to the window frame from the frame plate 10. This can cause the window frame to fail. However, with a reinforcing insert 400, the load applied to the bearing plate 24 from the frame plate 10 is spread, minimising the point load applied to the window frame.

The reinforcing insert 400 may be located in the bearing plate 24 between the window frame and at least part of an arm. For example, as shown in FIG. 2*b*, the reinforcing insert 400 is located in the bearing plate 24 so that part of the reinforcing insert (as indicated generally by arrow 406) is between the pivot of the short arm 12 connected to the frame plate (not shown) and where the window frame would be (not shown).

The reinforcing insert 400 may overlap with the frame plate 10. Thus, loads applied to the frame plate are transferred to the reinforcing insert 400 (via the bearing plate 24). In this way, the reinforcing insert 400 and the frame plate cooperate to spread the load from the window sash that is ultimately applied to the window frame.

The reinforcing insert 400 may be located so as to engage with at least part of the region 404 previously described. Since this region 404 does not include a frame plate, the reinforcing insert acts to reinforce the bearing plate 24 in this region. To increase the effectiveness, the reinforcing insert is located so as to overlap with the frame plate 10.

The reinforcing insert may include a strengthening form. The strengthening form may improve the strength or rigidity of the reinforcing insert. The strengthening form may be substantially aligned with the longitudinal axis of the frame plate. For example, the strengthening form may consist of a rib formed by folds pressed into the reinforcing insert or it may consist or a rib formed by adding additional material to the reinforcing insert.

Support Member

Figure 8A:
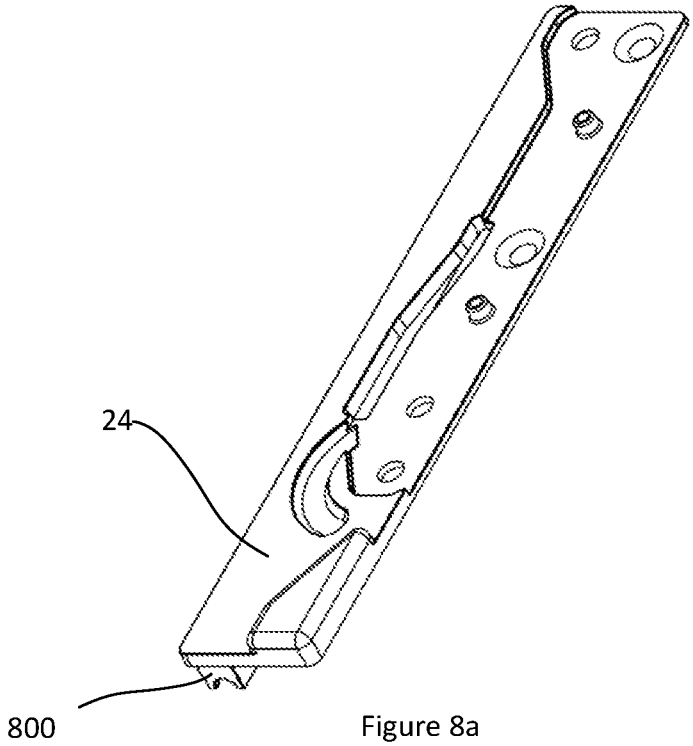
FIG. 8*a* shows a perspective view of a bearing plate including a support member according to one embodiment.
Figure 8B:
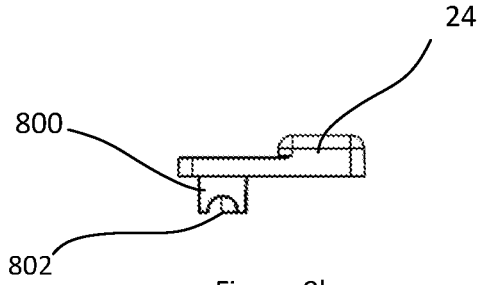
FIG. 8*b* shows an end view of the bearing plate of FIG. 8*a;*
Figure 8C:
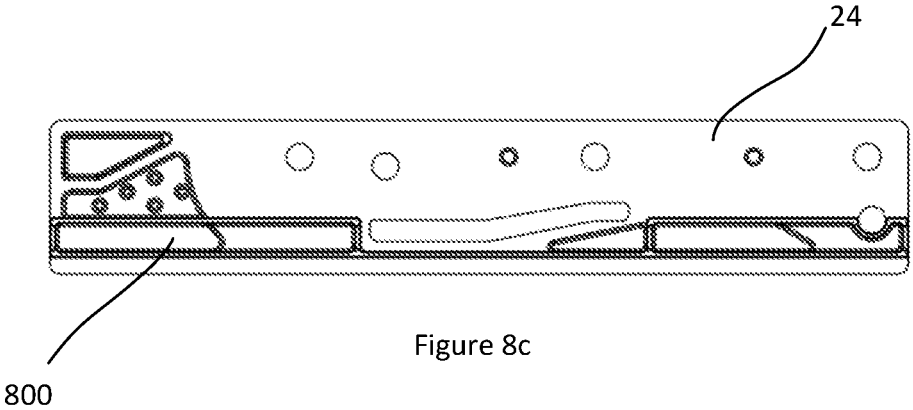
FIG. 8*c* shows a bottom view of the bearing plate of FIG. 8*a;*

Referring now to FIGS. 8*a* to 8*c*, the bearing plate 24 may include a support member 800.

As shown in FIGS. 8*a* and 8*b*, the support member 800 is a projection that extends from beneath the bearing plate 24. As shown in FIG. 8*c*, the support member 800 may be provided along the length of the bearing plate 24. The bearing plate may be sized and located so as to correspond to a channel in the window frame (as will be described in more detail below in relation to FIG. 9*c*). The support member may be formed integrally with the bearing plate. Therefore, if the bearing plate 24 is made of plastic, so too is the support member 800. If the supporting member is formed separately it may be made of aluminium, steel, stainless steel or plastic, and may be configured to be attached to the bearing plate (for example, via suitable lugs).

As shown in FIG. 8*b*, the support member may have a recess 802 (which in the embodiment shown in FIGS. 8*a* to 8*c* is semi-circular). The recess 802 ensures the support member does not prevent fluid flowing along the frame channel.

The support member helps support the bearing plate (and the rest of the window stay) particularly when the window is in a partially open or fully open position. The support member transfers the load of the bearing plate (which might otherwise be unsupported as described in relation to FIG. 9*a*) to the bottom of the frame channel. Beneficially, since the support member 800 is sized and located to correspond to a frame channel, the support member assists with alignment of the window stay with the window frame.

Window Frame

Figure 9A:
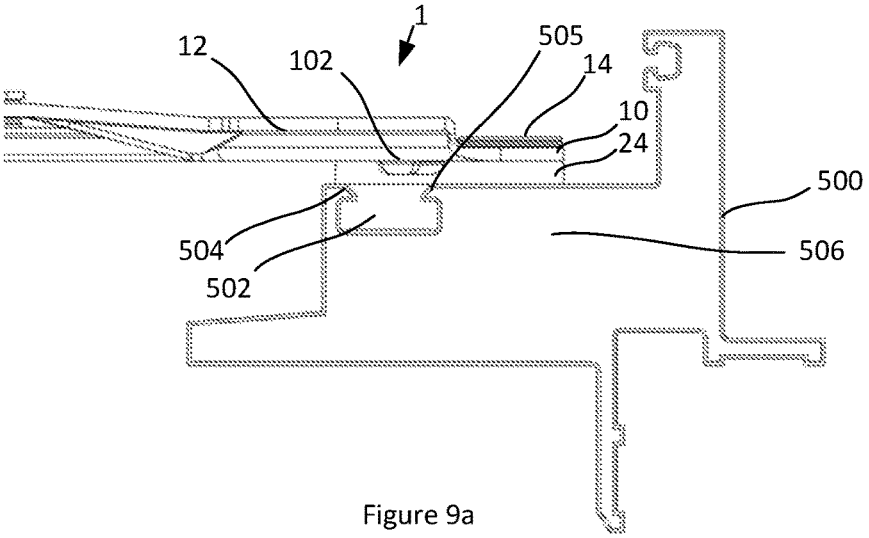
FIG. 9*a* is a cross-sectional view through B-B of the window stay of FIG. 3*b* without a reinforcing insert or support member and including part of a window frame.
Figure 9B:
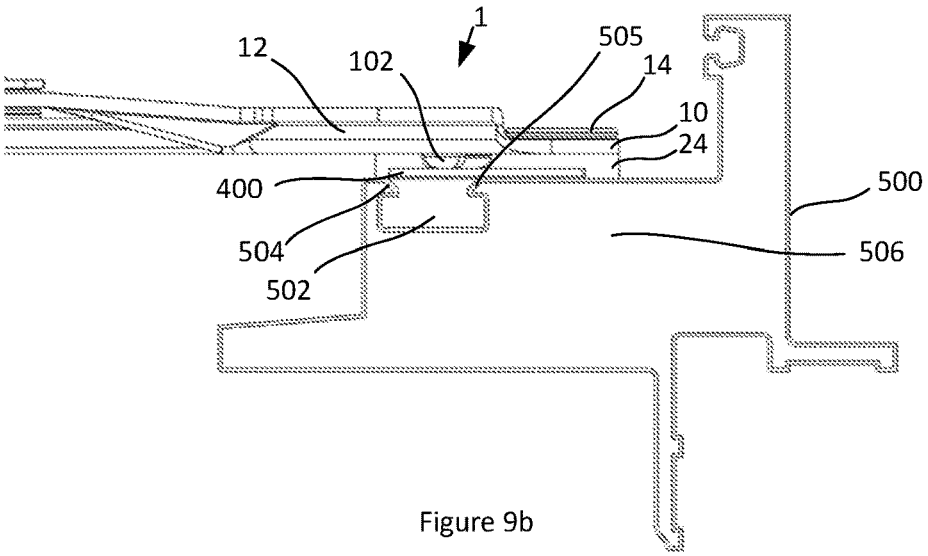
FIG. 9*b* is a cross-sectional view through B-B of the window stay of FIG. 3*b* with a reinforcing insert and including part of a window frame.
Figure 9C:
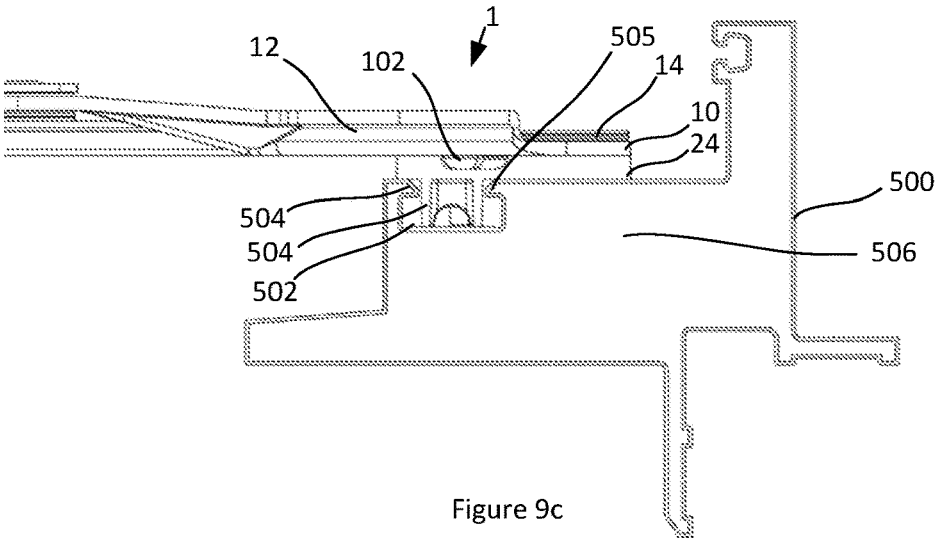
FIG. 9*c* is a cross-sectional view through B-B of the window stay of FIG. 3*b* without a support member and including part of a window frame.

FIGS. 9*a* to 9*c* show cross-sectional views of the window stay 1 of FIG. 3*b* through line B-B, without a reinforcing insert or support member, with a reinforcing insert and with a support member respectively. FIGS. 9*a* to 9*c* include a cross-sectional view of part of a window frame, showing an example window frame profile. The window frame may be formed by extrusion and it may be made of aluminium, uPVC or some other suitable material. The window frame 500 includes a frame channel 502, between a front flange 504 and a back flange 505 of the mounting region 506 (i.e. the part of the frame to which the window stay is attached with fasteners). The frame channel 502 is provided for drainage, as well as a recess into which other products may be clipped in e.g. window operators.

Referring to FIG. 9*a*, the window stay 1 has neither a reinforcing insert or a support member. When installed, the window stay is attached to the mounting region 506 by suitable fasteners (not shown). The bearing plate 24 is between the frame plate 10 and the mounting region 506. The bearing plate also engages with the front flange 504, thereby spanning the frame channel 502. When loads are applied to the window sash (not shown), the loads are applied to the short arm 12. These loads are then transferred to the bearing plate via the frame plate 10 and pivot 14. When the loads are sufficiently large, the bearing plate 24 may buckle or the flanges 504 505 of the frame may buckle.

Referring to FIG. 9*b*, the window stay 1 has a reinforcing insert 400 as previously described. As can be seen from FIG. 9*b*, the reinforcing insert 400 is located in the bearing plate 24 so as to be between the window frame 500 and part of the short arm 12 and part of the frame plate 10. The reinforcing insert extends across the frame channel 502. In the embodiment shown, the reinforcing insert does not engage with the front flange 504. When loads are applied to the window sash (not shown), the reinforcing insert 400 spreads the load transferred to the bearing plate (particularly the loading at the frame plate 10 and pivot 14). Thus, the window stay and window frame are less likely to buckle. Because the reinforcing insert does not engage with the front flange 504, the load across the channel is redistributed to the mounting region 506 and the load applied to the front flange is minimised.

Referring to FIG. 9*c*, the window stay 1 has a support member 800 as previously described. As can be seen from FIG. 9*c*, the support member 800 is formed integrally with the bearing plate and extends to the bottom of the frame channel 502. When loads are applied to the window sash (not shown), the support member supports the bearing plate 24 above the frame channel 502. Thus, the window stay and window frame are less likely to buckle.

While the present invention has been illustrated by the description of the embodiments thereof, and while the embodiments have been described in detail, it is not the intention of the Applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the Applicant's general inventive concept.

The invention claimed is:

1. A window stay, comprising:

a frame plate;

at least one arm coupled to the frame plate by a frame plate pivot; and a bearing plate engaged with the frame plate, the bearing plate and the frame plate together configured to be mounted to a window frame;

wherein the bearing plate comprises a reinforcing insert for spreading a load applied through at least part of the at least one arm to the bearing plate;

wherein the reinforcing insert is made of a material with more strength and/or rigidity than the material of the bearing plate.

2. The window stay as claimed in claim 1, wherein one or more of:

the bearing plate is made of plastic;

the reinforcing insert is made of a material with more strength and/or rigidity than the plastic;

the reinforcing insert is made of one of aluminium, steel or stainless steel.

3. The window stay as claimed in claim 1, wherein in use the bearing plate is disposed between the window frame and the frame plate, and the bearing plate has a first region which extends longitudinally beyond an end of the frame plate, the first region not engaged with the frame plate.

4. The window stay as claimed in claim 3, wherein the reinforcing insert is disposed in the bearing plate between the window frame and at least part of the at least one arm so as to engage with at least part of the first region.

5. The window stay as claimed in claim 1, wherein the bearing plate has an insert recess for receiving the reinforcing insert, and the reinforcing insert is substantially or fully enclosed in the bearing plate.

6. The window stay as claimed in claim 1, wherein at least one of the reinforcing insert or the frame plate comprises a strengthening form substantially aligned with a longitudinal axis of the frame plate.

7. The window stay as claimed in claim 1, further comprising a sash plate, and wherein the at least one arm comprises:

a short arm coupled by a pivot at each end to the frame plate and the sash plate; and a long arm coupled by a pivot at each end to the frame plate and the sash plate.

8. The window stay as claimed in claim 7, wherein the reinforcing insert is disposed between the window frame and at least part of the pivot coupling the short arm to the frame plate.

9. The window stay as claimed in claim 8, wherein the geometry of the window stay is such that, in a closed position of the window stay, the pivot coupling the long arm to the sash plate is situated between the pivot coupling the frame plate to the short arm and the pivot coupling the sash plate to the short arm.

10. A window assembly comprising a window frame, a window sash and at least one window stay as claimed in claim 1.

11. A window stay comprising:

a frame plate;

at least one arm coupled to the frame plate by a frame plate pivot; and a bearing plate engaged with the frame plate, the bearing plate and the frame plate together configured to be mounted to a window frame having a frame channel;

wherein the bearing plate comprises a reinforcing insert for spreading a load applied through at least part of the at least one arm to the bearing plate and a support member for supporting the bearing plate above the frame channel and the support member is a projection that extends from beneath the bearing plate.

12. The window stay as claimed in claim 11, wherein at least one of:

the bearing plate is made of plastic;

the support member is made of one of aluminium, steel, stainless steel or plastic;

the support member is formed integrally with the bearing plate.

13. The window stay as claimed in claim 11, wherein the support member is disposed between a bottom of the frame channel and at least part of the at least one arm.

14. The window stay as claimed in claim 11, further comprising a sash plate, and wherein the at least one arm comprises:

a short arm coupled by a pivot at each end to the frame plate and the sash plate; and a long arm coupled by a pivot at each end to the frame plate and the sash plate.

15. The window stay as claimed in claim 11, wherein the support member is provided along the length of the bearing plate.

16. The window stay as claimed in claim 11, wherein the support member Is configured to be located within the frame channel.

17. The window stay as claimed in claim 11, wherein the support member is configured to transfer a load of the bearing plate to the bottom of the frame channel.

18. The window stay as claimed in claim 11, wherein the support member comprises a recess.

19. A window assembly comprising a window frame, a window sash and at least one window stay as claimed in claim 11.

* * * * *